US005876653A

United States Patent [19]

Fukuba

[11] Patent Number: 5,876,653

[45] Date of Patent: Mar. 2, 1999

[54] PORTABLE SOLID CLOTH PRODUCT AND METHOD OF FABRICATING THE SAME

[75] Inventor: Akira Fukuba, Hiroshima, Japan

[73] Assignee: Kabushiki Kaisha Hikari, Hiroshima, Japan

[21] Appl. No.: 337,313

[22] Filed: Nov. 10, 1994

Related U.S. Application Data

[62] Division of Ser. No. 21,347, Feb. 23, 1993, abandoned.

[30] Foreign Application Priority Data

Feb. 28, 1992 [JP] Japan ..... 4-078847

[51] Int. Cl.[6] ..... D04H 1/16

[52] U.S. Cl. ..... 264/293; 264/132; 428/280; 428/282; 428/284; 428/286; 428/287; 101/32; 101/41

[58] Field of Search ..... 428/280, 282, 428/284, 286, 287; 38/144, 17, 29, 70, 71; 223/37, 38; 100/35, 240; 101/32, 41; 264/132, 293

[56] References Cited

U.S. PATENT DOCUMENTS

| | | | |
|---|---|---|---|
| 3,502,530 | 3/1970 | Adams et al. | 264/134 |
| 3,989,172 | 11/1976 | Wiedemann et al. | 223/71 |
| 4,106,260 | 8/1978 | King | 53/21 |
| 4,293,609 | 10/1981 | Erickson | 428/286 |
| 5,031,525 | 7/1991 | Kent et al. | 101/32 |
| 5,417,351 | 5/1995 | Grosz | 223/37 |

FOREIGN PATENT DOCUMENTS 53-2125 6/1978 Japan .

*Primary Examiner*—Thurman K. Page
*Assistant Examiner*—Kathryne E. Shelborne
*Attorney, Agent, or Firm*—Flynn, Thiel, Boutell & Tanis, P.C.

[57] ABSTRACT

A half-finished folded soft cloth product, which is formed in an almost box shape by folding the soft cloth product such as a shirt, a handkerchief, a towel, etc., is put in a square frame on a lower die interposing a hard rubber plate thereunder, and thereafter is compressed between the lower die and an upper die to form a solid cloth product, which is convenient for carrying.

12 Claims, 6 Drawing Sheets

PORTABLE SOLID CLOTH PRODUCT AND METHOD OF FABRICATING THE SAME

This application is a continuation division of U.S. Ser. No. 08/021 347, filed Feb. 23, 1993 now abandoned.

BACKGROUND OF THE INVENTION

1. Field of the Invention:

The present invention relates to a portable cloth product for carrying a shirt, a handkerchief, a towel, etc.

2. Description of the Prior Art:

Spare clothes such as a shirt, handkerchief, etc., have been carried so far in a folded and soft state.

Conventional cloth products are very bulky as they are carried in a soft state. Therefore, it is very inconvenient to take them for traveling, particularly for traveling abroad.

Means for condensing cloth products have been already known such as that disclosed in the Japanese Utility Model Publication No. 53-21215. However, since cloth products have thick portions such as folded selvages, sutures, etc., so that there is the possibility of not only generating wrinkles in the surface of the cloth products when the same is simply pressed by a press, but also damaging the texture when a strong pressure is applied to the portions where cloths overlap each other.

SUMMARY OF THE INVENTION

Accordingly, it is the object of the present invention to provide a small solid cloth product having a flat surface illustrated with desired letters or drawings which is made by condensing a cloth product for facilitating transportation thereof without damaging the texture thereof.

Referring to drawings, the portable solid cloth product according to the present invention is composed of a nearly box-shaped folded soft cloth product 21 compressed between lower and upper dies 42 and 43 in a square frame 45, the nearly box-shaped folded soft cloth product 21 which is a half-finished product being arranged on a hard rubber plate 44 in the square frame 45.

The method of fabricating the portable solid cloth product comprises the steps of placing the half-finished folded soft cloth product 21 which is folded in an almost box shape in the square frame 45 arranged on the lower die 42 interposing a hard rubber plate 44 thereunder and compressing the folded soft cloth product 21 between the lower and upper dies 42 and 43.

When the solid cloth product is made by the press without interposing the hard rubber plate thereunder, wrinkles are generated on the surface thereof, spoiling its marketability. However, when the hard rubber plate is interposed under the solid cloth product, the wrinkles are eliminated and letters and symbols engraved on the lower surface of the upper die are clearly embossed on the surface of the solid cloth product. The solid cloth product is very small-sized, convenient as spare clothes for traveling, particularly for traveling abroad, and useful to be carried in a traveling bag.

DESCRIPTION OF THE PREFERRED EMBODIMENT

Figure 1:
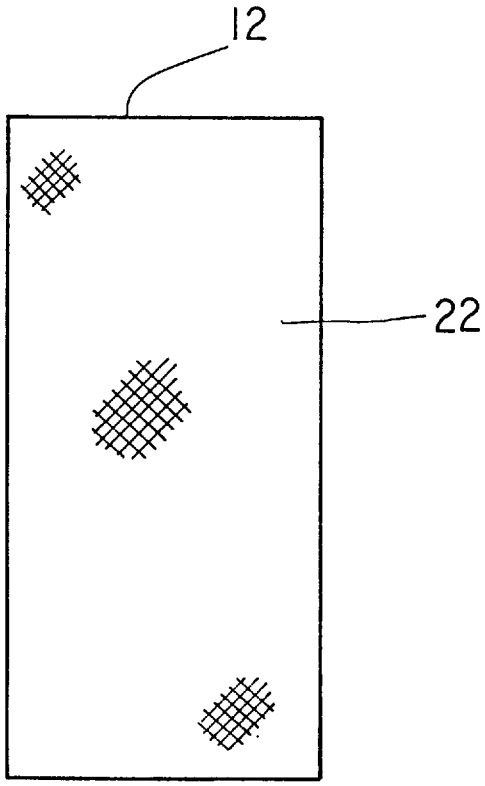
FIG. 1 is a plan view of a towel.
Figure 2:
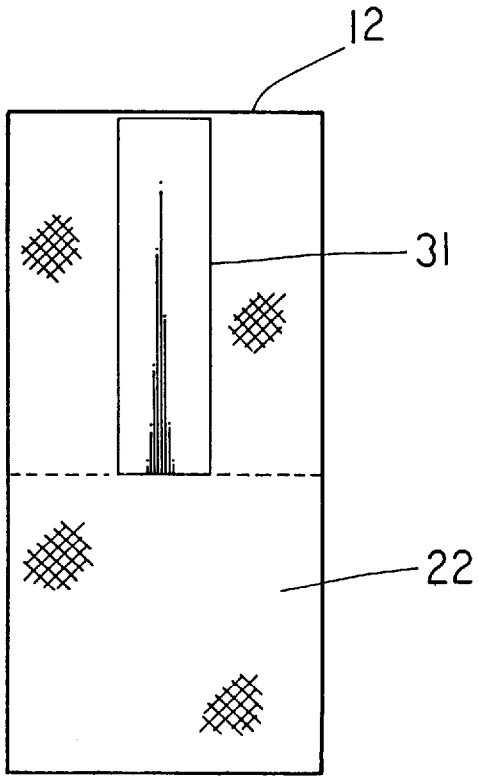
FIG. 2 is a plan view showing a first process of fabricating a half-finished cloth product from the towel.
Figure 3:
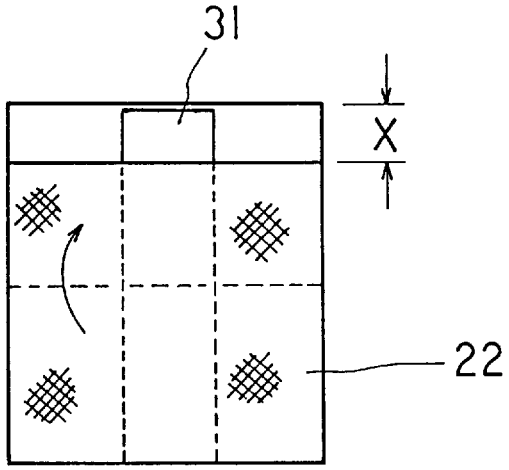
FIG. 3 is a plan view showing a second process of fabricating a half-finished cloth product from the towel.
Figure 4:
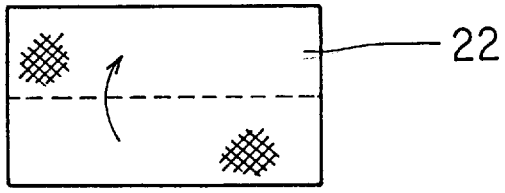
FIG. 4 is a plan view showing a third process of fabricating a half-finished cloth product from the towel.
Figure 5:
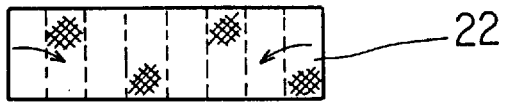
FIG. 5 is a plan view showing a fourth process of fabricating a half-finished cloth product from the towel.
Figure 6:
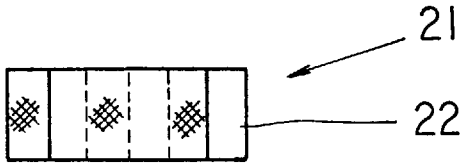
FIG. 6 is a plan view showing a fifth process of fabricating a half-finished cloth product from the towel.
Figure 7:
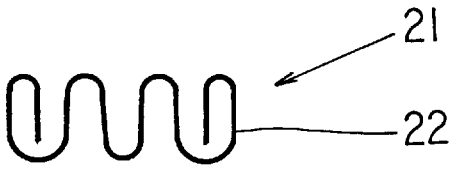
FIG. 7 is a front view of FIG. 6 and a bottom view thereof when it is put on the lower die.

A towel 22 is exemplified as a cloth product for explaining the fabrication of the half-finished nearly box-shaped folded soft cloth product. The towel 22 is turned over as illustrated in FIG. 1. A gauge 31 is put thereon with the upper edge thereof conforming to the upper end line 12 of the towel 22 as illustrated in FIG. 2. The towel 22 is folded double leaving the upper end thereof by X while the gauge 31 is put thereon as illustrated in FIG. 3. Then the gauge 31 is removed as illustrated in FIG. 4. The folded towel 22 is turned over, and is further folded double as illustrated in FIG. 5. The folded towel 22 in FIG. 5 is rolled in at both end thereof and is folded in a folding screen way as illustrated in FIGS. 6 and 7 to make a half-finished nearly box-shaped folded soft cloth product 21.

Figure 8:
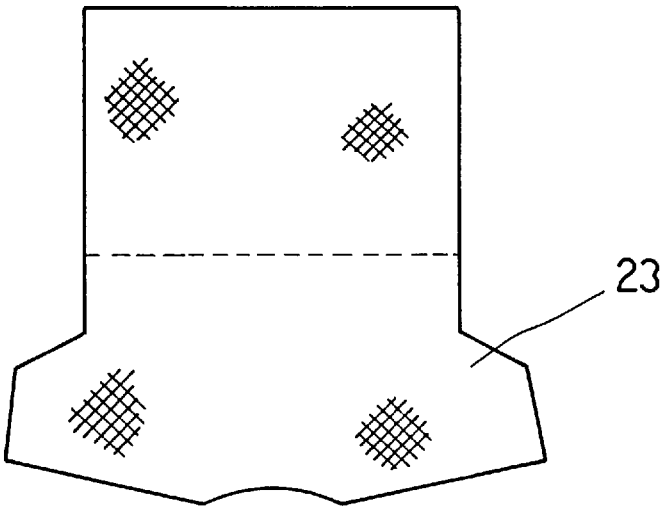
FIG. 8 is a plan view of a shirt.
Figure 9:
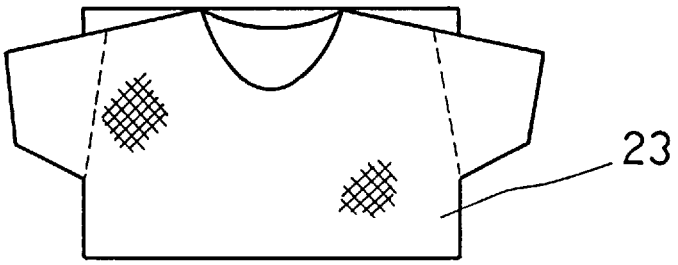
FIG. 9 is a plan view showing a first process of fabricating a half-finished cloth product from the shirt.
Figure 10:
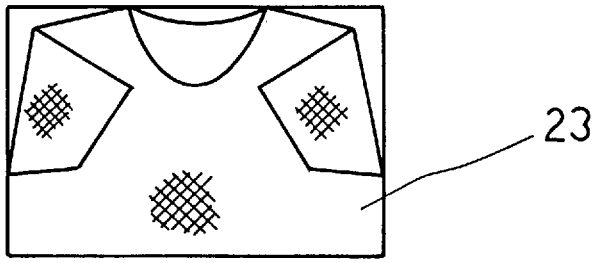
FIG. 10 is a plan view showing a second process of fabricating a half-finished cloth product from the shirt.
Figure 11:
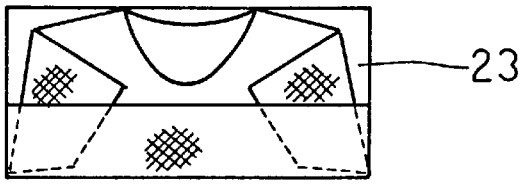
FIG. 11 is a plan view showing a third process of fabricating a half-finished cloth product from the shirt.
Figure 12:
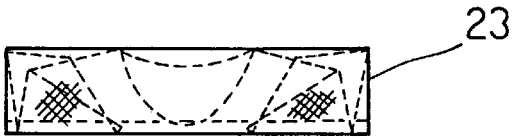
FIG. 12 is a plan view showing a fourth process of fabricating a half-finished cloth product from the shirt.
Figure 13:
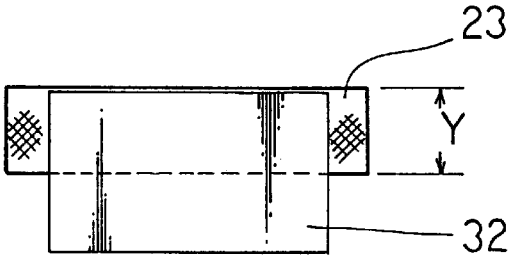
FIG. 13 is a plan view showing a fifth process of fabricating a half-finished cloth product from the shirt.
Figure 14:
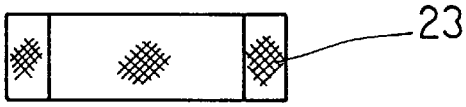
FIG. 14 is a plan view showing a sixth process of fabricating a half-finished cloth product from the shirt.
Figure 15:
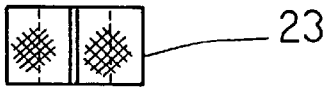
FIG. 15 is a plan view showing a seventh process of fabricating a half-finished cloth product from the shirt.
Figure 16:
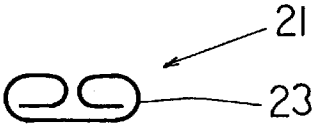
FIG. 16 is a front view of FIG. 15 and a bottom view thereof when it is put on the lower die.

Then a shirt 23 is exemplified as a cloth product for explaining the fabrication of the half-finished nearly box-shaped folded soft cloth product. The shirt 23 is put with the backside thereof upside and with its neck toward the operator as illustrated in FIG. 8. The shirt 23 is folded double while smoothing out wrinkles therefrom and keeping the neck inside the bottom line thereof as illustrated in FIG. 9. The sleeves are folded along the lines between the shoulders and the armpits as illustrated in FIG. 10. The gauge 33 is put along the bottom line and the lower portion of the folded shirt which is not covered by the gauge 33 is folded up taking care not to leave wrinkles inside the folded portion as illustrated in FIG. 11. The folded shirt 23 is further folded double and is turned over so as to make the bottom side thereof visible as illustrated in FIG. 12. The other gauge 32 is put on the center of the folded shirt 23 and the width Y thereof is ascertained to conform to that of the gauge 32 as illustrated in FIG. 13. If the folded shirt 23 protrudes out of the gauge 32, the protruding portions thereof are folded inside again as illustrated in FIG. 14. Then the folded shirt 23 is further folded up bisymmetrically so as to be short laterally as illustrated in FIGS. 15 and 16. As a result, a half-finished nearly box-shaped folded soft cloth product is made.

Figure 17:
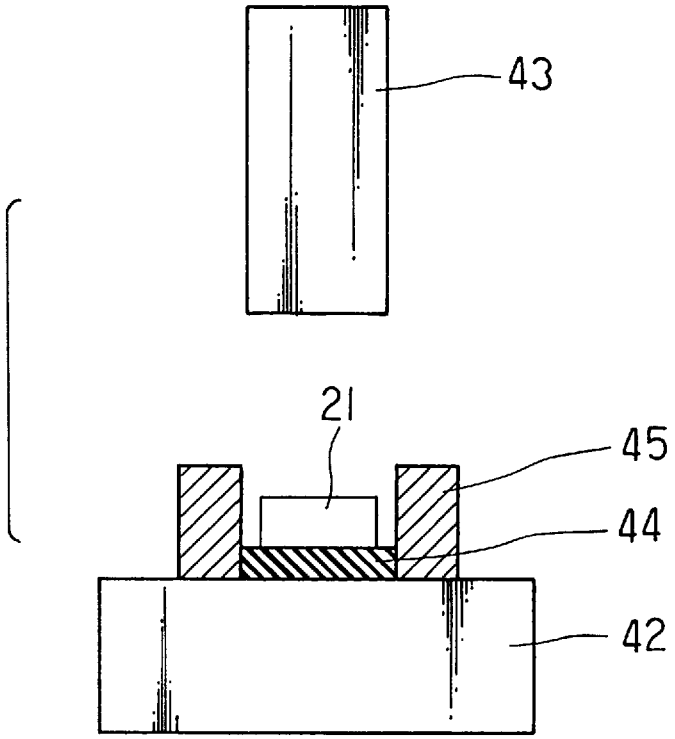
FIG. 17 is a front view showing a half-finished soft cloth product placed on the lower die to be pressed.
Figure 18:
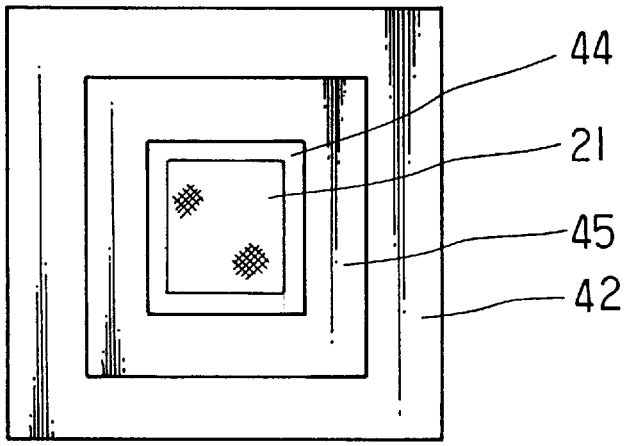
FIG. 18 is a plan view showing a state in which the upper die is removed in FIG. 17.
Figure 19:
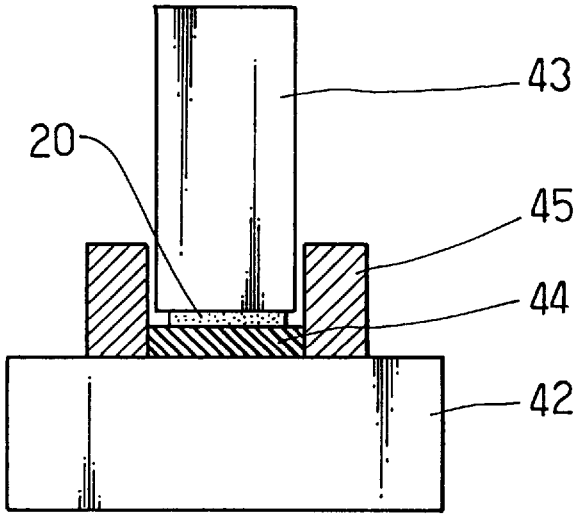
FIG. 19 is a view showing a state in which the upper die is lowered in FIG. 17, wherein a frame, a hard rubber plate and a compressed cloth product are shown in cross section.
Figure 20:
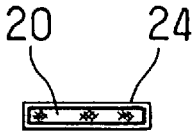
FIG. 20 is a plan view showing a solid cloth product wrapped up.

The half-finished soft cloth product 21 is put on a hard rubber plate 44 such as a urethane rubber plate etc. in an upward opening square frame 45 on the lower die 42 of a press 11 so as to project upwardly therefrom as illustrated in FIG. 17. An upper die 43 on the lower surface of which letters or patterns are engraved is fit into the square frame 45 and is pressed down. Then the half-finished soft cloth product 21 is pressed against the lower die 42 by way of the hard rubber plate 44 by the pressure of about 50 tons so as to reduce the thickness thereof to substantially create a solid cloth product 20 as shown in FIG. 19. The solid cloth product 20 is wrapped with a synthetic resin film 24 as illustrated in FIG. 20. As a result, the solidsoft cloth product is of a smaller thickness and greater density than the folded soft cloth product. The solid cloth product 20 is formed as a box shape on the order of 11 cm×7 cm×1 cm in case of a towel. The solid cloth product 20 can restore its original shape such as that of a towel or a shirt by crumpling up the same with hands. When a wet towel is needed, it is enough to soak the solid cloth product 20 in water to have the same restored.

What is claimed is:

1. A method of fabricating a portable solid cloth product from a folded soft cloth product wherein said portable solid cloth product is of a smaller thickness and greater density than said folded soft cloth product and has a flat surface having letters or patterns therein, comprising the steps of:

positioning said folded soft cloth product which is formed in an almost box shape in an upward opening frame arranged on a lower die so as to project upwardly therefrom and interposing a hard rubber plate between the folded soft cloth product and the lower die; and compressing said folded soft cloth product between said lower die and an upper die on the lower surface of which letters or patterns are engraved to reduce the thickness thereof and form said solid cloth product with said letters or patterns being embossed therein while substantially eliminating creation of wrinkles on the surface of the solid cloth product.

2. A method of fabricating said solid cloth product according to claim 1, wherein said frame is square, and said hard rubber plate is a urethane rubber plate.

3. A method of fabricating said solid cloth product according to claim 1, wherein said step of compressing includes the step of moving said upper and lower dies one towards the other to compress said folded soft cloth product between opposing surfaces of said rubber plate and said upper die and form said solid cloth product which has said smaller thickness and said greater density.

4. A method according to claim 3, wherein said folded soft cloth product is a half-finished product.

5. A method according to claim 1, further including the step of folding a cloth product to form said folded soft cloth product.

6. A method for forming a cloth product into a solid cloth product comprising the steps of:

providing a press having first and second dies which are movable relative to each other and have respective first and second surfaces disposed in opposing relation;

positioning a rubber plate on said first surface of said first die;

folding the cloth product into a folded soft cloth product;

positioning said folded soft cloth product between said rubber plate which is disposed on one side of said folded soft cloth product and said second surface of said second die which is disposed on another side of said folded soft cloth product; and compressing said folded soft cloth product between said second die and said rubber plate to form a solid cloth product having a reduced thickness and increased density relative to said folded soft cloth product, said compressing of said folded soft cloth product comprising the step of moving one of said first and second dies toward the other of said first and second dies to compress said folded soft cloth product between said second die and said rubber plate at a pressure which forms said solid cloth product while substantially eliminating the creation of wrinkles on a surface of said solid cloth product.

7. A method according to claim 6, wherein said folded soft cloth product is substantially box-shaped after said folding of said cloth product.

8. A method according to claim 6, wherein the entirety of said folded soft cloth product is disposed between said rubber plate and said second die.

9. A method according to claim 8, wherein said step of positioning said rubber plate on said first surface of said first die includes the step of inserting said rubber plate into a frame of said first die which opens toward said second die, said folded soft cloth product being positioned within said frame.

10. A method according to claim 9, wherein said step of moving said one of said first and second dies comprises the step of inserting said second die into said frame of said first die.

11. A method for forming a cloth product into a solid cloth product having a flat surface with letters or patterns comprising the steps of:

providing a press having first and second dies which are movable relative to each other and have respective first and second surfaces disposed in opposing relation, said second surface being engraved with letters or patterns;

positioning a rubber plate on said first surface of said first die;

folding the cloth product into a folded soft cloth product;

positioning said folded soft cloth product between said rubber plate and said second die; and compressing said folded soft cloth product between said second die and said rubber plate to form a solid cloth product having a reduced thickness and increased density relative to said folded soft cloth product, said compressing of said folded soft cloth product comprising the step of moving one of said first and second dies toward the other of said first and second dies to compress said folded soft cloth product between said second die and said rubber plate at a pressure which forms said solid cloth product with said letters or patterns embossed on said flat surface while substantially eliminating the creation of wrinkles on said flat surface of said solid cloth product.

12. A method of forming a cloth product into a solid cloth product according to claim 11, wherein said rubber plate and said second die include respective opposing surfaces, and said folded soft cloth product is positioned between said opposing surfaces so as to be compressed therebetween.

* * * * *

UNITED STATES PATENT AND TRADEMARK OFFICE

CERTIFICATE OF CORRECTION

PATENT NO. : 5 876 653

DATED : March 2, 1999

INVENTOR(S) : Akira FUKUBA

It is certified that error appears in the above-identified patent and that said Letters Patent is hereby corrected as shown below:

Column 3, line 58; change "claim 3,"
to ---claim 1,---.

Signed and Sealed this

Seventh Day of September, 1999

*Attest:*

*Attesting Officer*

Q. TODD DICKINSON

*Acting Commissioner of Patents and Trademarks*